United States Patent [19]

Birney

[11] 4,034,734

[45] July 12, 1977

[54] TUBELESS HEAT EXCHANGERS

[75] Inventor: Austin Birney, Salisbury, Rhodesia

[73] Assignee: Airflo Limited, Salisbury, Rhodesia

[21] Appl. No.: 575,397

[22] Filed: May 7, 1975

[51] Int. Cl.$^2$ ..... F24H 3/10

[52] U.S. Cl. ..... 126/110 B; 165/DIG. 2

[58] Field of Search ..... 126/110 R, 110 B, 116 R; 165/DIG. 2

[56] References Cited

U.S. PATENT DOCUMENTS

| | | | |
|---|---|---|---|
| 2,962,218 | 11/1960 | Dibert | 126/110 R |
| 3,171,399 | 3/1965 | Kirgan | 126/110 B |
| 3,822,690 | 7/1974 | Kofink | 126/110 B |
| 3,894,526 | 7/1975 | Kofink | 126/110 B |

*Primary Examiner*—William E. Wayner
*Assistant Examiner*—William E. Tapolcai, Jr

[57] ABSTRACT

A heat exchanger comprising a combustion chamber adapted to burn fuel having an inlet at one end for fuel and an outlet at the other end for exhaust gases and wherein a sheath surrounds the combustion chamber to form a chamber for heated air, the combustion chamber having a plurality of radial fins projecting into the heated air chamber. One of the ends of the sheath is axially spaced from the end of the combustion chamber having the fuel inlet and the other end of the sheath extends axially beyond the other end of the combustion chamber to an outlet for discharge of heated air. A second sheath surrounds the first sheath and encloses the combustion chamber and defines an annular space with the second sheath open to ambient air which flows through the annular space and then through the air chamber past the fins to the outlet for heated air.

5 Claims, 3 Drawing Figures

TUBELESS HEAT EXCHANGERS

This invention relates to heat exchangers and particularly to those known as tubeless heat exchangers wherein there is no direct contact between combustion gases and an airstream to be heated.

Various forms of heat exchangers are known all or the majority of which are especially adapted and designed for firing of gas or oil in the combustion chamber.

In view of existing liquid fuel shortages and the probability that this shortage will increase, the inventor of has devised an improved heat exchanger of the kind in question which will minimize existing disadvantages.

According to the invention, a heat exchanger includes a combustion chamber adapted to burn solid or fluid fuel, the external walls of the combustion chamber being provided with a plurality of formations outstanding from the walls into a space defined between the external walls of the combustion chamber and the internal walls of a sheath disposed about at least part of the combustion chamber; the sheath being constructed and arranged to channel ambient air drawn through an inlet over the formations to an outlet for heated air; a stoke hole or the like in one wall of the combustion chamber and an exhaust port for burnt gases in another wall of the combustion chamber.

In one form of the invention, the combustion chamber is constructed from metal and is cylindrical in outline and means is provided which is adapted to extract combustion gases from the combustion chamber via the outlet port.

A customary type of fire grate is disposed in the lower area of the combustion chamber and runs substantially the whole lateral length of the combustion chamber from a stoke hole in one vertical wall to the throat of the chamber in the opposite vertical wall, the throat being associated with a flue or duct leading to a chimney.

In this form of the invention, the external wall of the combustion chamber is provided with a large number of fins running axially along the length of the combustion chamber, these fins being directed radially outwardly.

Surrounding the fins is a sheath comprising a pair of co-axially disposed metal cylinders arranged to provide a double passage way for ambient air. In a further form of the invention, a pre-heat chamber is provided in the form of a cylindrical metal sheath disposed about the furnace outlet duct and/or part of the chimney.

In order to illustrate the nature of the invention and how it may best be put into operation, an example of a preferred type of furnace will be described in detail with reference to the accompanying drawings in which.

Figure 1:
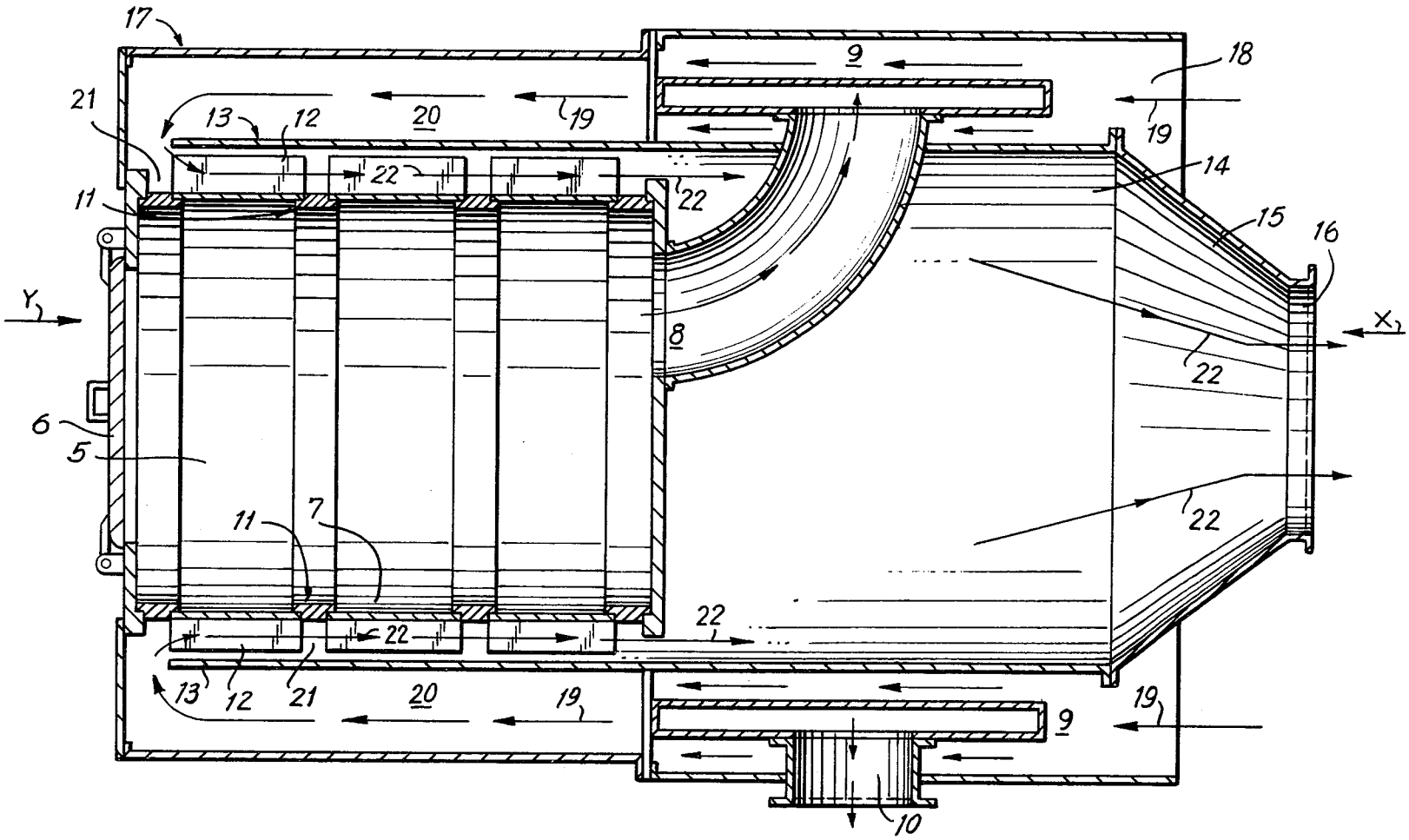
FIG. 1 is a sectional side elevation view of the furnace according to the invention.
Figure 2:
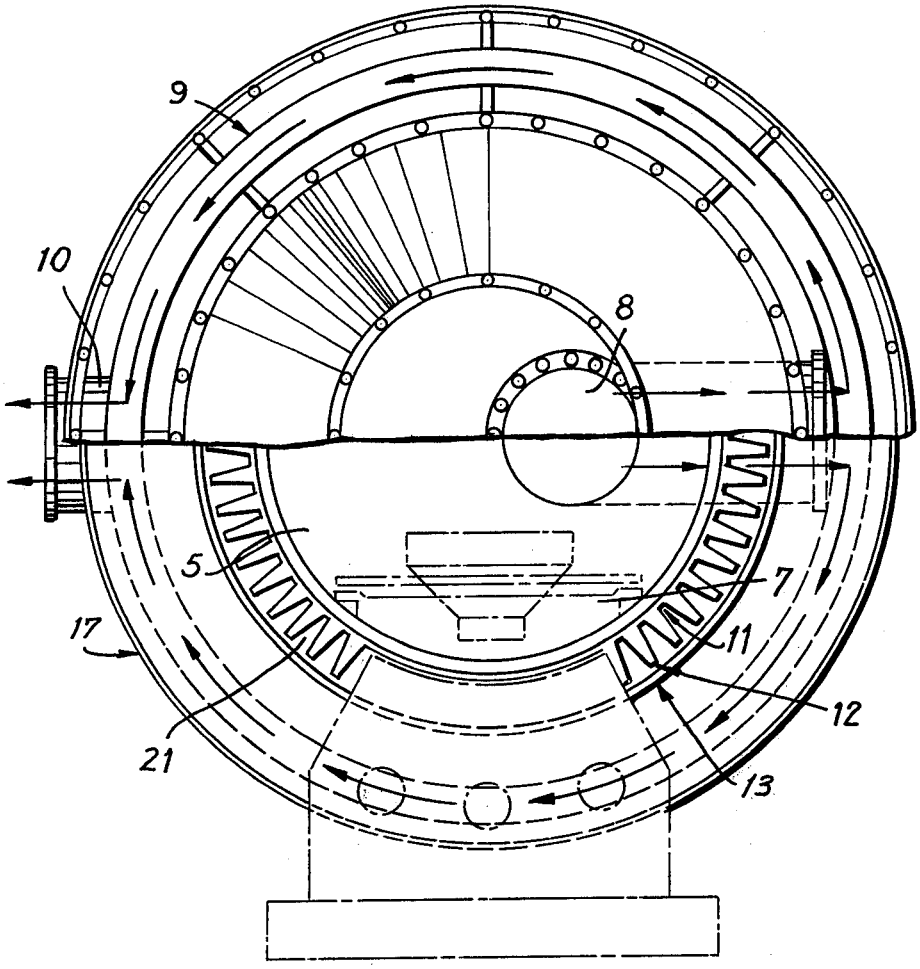
FIG. 2 is an end elevational view, partly in section, on a horizontal plane.
Figure 3:
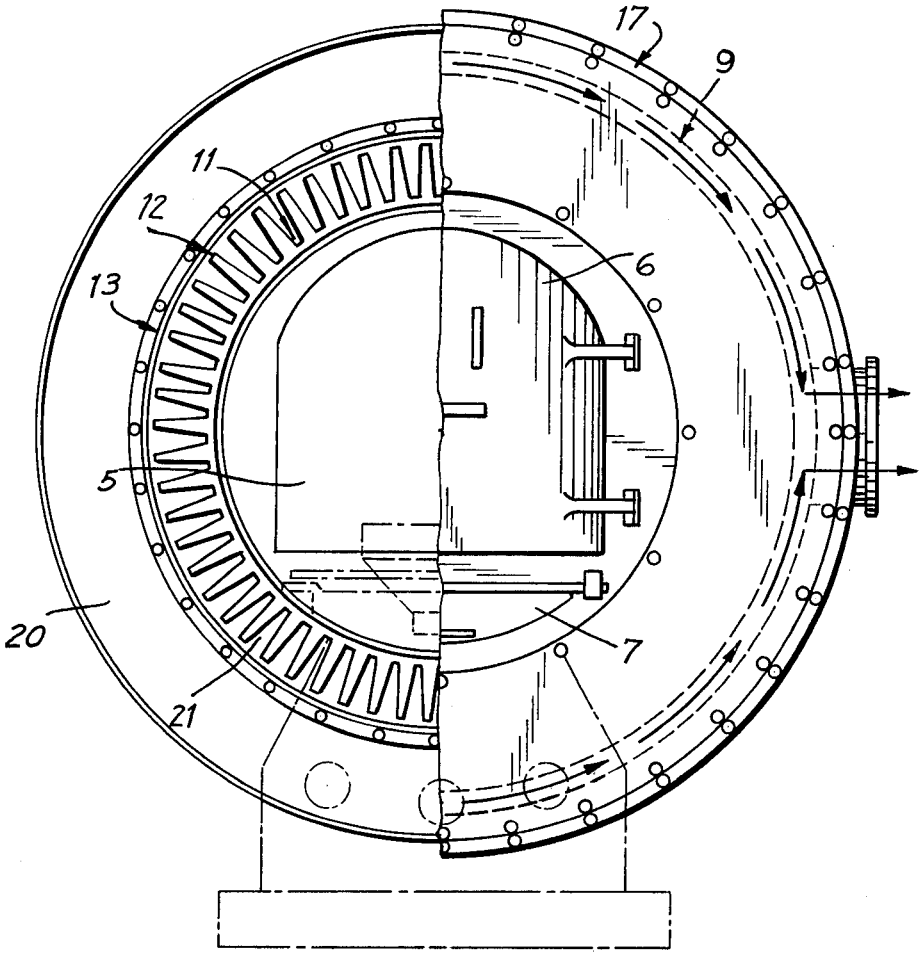
FIG. 3 is an elevational view, partly in section on a vertical plane.

Referring to the drawings numeral 5 indicates a combustion chamber provided with a stoke hole door 6; a fire grate 7; an outlet throat 8 leading to a pre-heat chamber 9 and furnace discharge port 10.

Forced draft arrangements may be provided in the customary manner but are not illustrated in this example.

The outer peripheral area 11 of the combustion chamber 5 is provided with a multiplicity of fins 12 upstanding radially and disposed laterally along the surface 11 of the combustion chamber 5. Immediately surrounding the fins 12 is a steel sheath 13 which extends from the edge of the fins 12 nearest to the stoke hole door 6 laterally and co-axially with the combustion chamber 5 to form a heated air chamber 14 which is provided with a conical throat 15 and an outlet port 16 for hot air.

Overlying sheath 13 amd spaced therefrom is a further sheath 17 also cylindrical and co-axial with combustion chamber 5 and sheath 13. Sheath 17 forms the outer skin of the heat exchanger unit.

Sheath 17 is formed integrally with pre-heat chamber 9 and has an opening 18 adjacent to throat 15 of the hot air chamber 14 which opening 18 permits ambient air to be drawn into the annular space between sheath 13 and 17.

This air, after passing through port 18 travels through pre-heat chamber 9 in the direction of arrows 19 and after passing through the annular space 20 immediately defined between sheaths 13 and 17 it is constrained to pass into second annular space 21 and follow the direction of arrows 22 passing over fins 12 and entering chamber 14 thereafter passing through throat 15 and exit port 16. Once again forced air by customary means may be provided to induce ambient air to pass along the passages and over the heat exchanger fins 12 but this is common engineering practice and entirely a matter of choice.

It will be appreciated by those skilled in the art that a compact and versatile solid or fluid fuel heat exchanger is provided by the design herein described which lends itself to easy cleaning and minimum maintenance while providing a highly efficient heat exchanging apparatus.

What is claimed is:

1. A heat exchanger comprising a combustion chamber adapted to burn a fuel, said chamber having opposite ends with an inlet at one end for fuel and an outlet at the other end for exhaust gases, said chamber having an external wall with a plurality of radial fins on said wall, a sheath surrounding said combustion chamber, said sheath having an inner surface facing the external wall of said combustion chamber to define a heated air space, said fins projecting in said air space, said sheath having opposite ends one of which is axially spaced from the said one end of the combustion chamber to define a reversing passageway, the other end of the sheath extending axially beyond the other end of the combustion chamber and including a heated air chamber and outlet means for discharge of heated air, a second sheath surrounding the first sheath and defining an annular space therewith, said annular space having an inlet opening remote from the inlet of the combustion chamber for inlet of ambient air into said annular space which flows therethrough to said reversing passageway and then flows through said heated air space and past said fins to said heated air chamber and said outlet means, said second sheath comprising first and second coaxially disposed cylinders connected in end to end relation, the first cylinder surrounding the combustion chamber, the second cylinder surrounding the heated air chamber, a duct extending from said outlet of said combustion chamber for discharge of the exhaust gases, said duct passing through said first sheath, and an annular pre-heat chamber connected to said duct, said pre-heat chamber being disposed in said annular space within said second cylinder around said heated air chamber and in heat-transfer relation with the ambient air flowing in said annular space.

2. A heat exchanger as claimed in claim 1 wherein said combustion chamber and said sheaths are cylindrical and coaxial.

3. A heat exchanger as claimed in claim 2 comprising a fire grate in said combustion chamber extending substantially the entire axial length thereof.

4. A heat exchanger as claimed in claim 1 wherein said one end of the sheath is aligned substantially with the first of the radial fins on said combustion chamber.

5. A heat exchanger as claimed in claim 1 comprising a conical throat on said first sheath at said outlet means thereof.

* * * * *